US009528274B2

(12) United States Patent
Curtis

(10) Patent No.: US 9,528,274 B2
(45) Date of Patent: Dec. 27, 2016

(54) MASONRY SIDING WITH EMBEDDED INSERTS AND METHOD

(71) Applicant: Silverwood Stone Corp., Fredericton, CA (US)

(72) Inventor: Caleb Curtis, Fredericton, CA (US)

(73) Assignee: SILVERWOOD STONE CORP., Fredericton (CA)

( * ) Notice: Subject to any disclaimer, the term of this patent is extended or adjusted under 35 U.S.C. 154(b) by 0 days.

(21) Appl. No.: 14/612,866

(22) Filed: Feb. 3, 2015

(65) Prior Publication Data

US 2015/0218829 A1 Aug. 6, 2015

Related U.S. Application Data

(60) Provisional application No. 61/935,292, filed on Feb. 3, 2014.

(51) Int. Cl.

| | |
|---|---|
| ***E04B 2/00*** | (2006.01) |
| ***E04F 13/14*** | (2006.01) |
| ***E04F 13/08*** | (2006.01) |
| ***B28B 1/00*** | (2006.01) |
| ***B28B 7/00*** | (2006.01) |
| ***B28B 23/00*** | (2006.01) |

(52) U.S. Cl.

CPC ..... *E04F 13/141* (2013.01); *B28B 1/008* (2013.01); *B28B 7/0073* (2013.01); *B28B 23/005* (2013.01); *E04F 13/0837* (2013.01); *E04F 13/0866* (2013.01); *E04F 13/0873* (2013.01)

(58) Field of Classification Search

CPC .. E04F 13/0832; E04F 13/077; E04F 13/0866; E04F 13/0873; E04F 13/141; E04F 13/0837; B28B 7/0073; B28B 1/008; B28B 23/005

USPC ..... 52/506.05, 384, 506.01, 516, 386, 388,52/389, 391

See application file for complete search history.

(56) References Cited

U.S. PATENT DOCUMENTS

| | | | | | |
|---|---|---|---|---|---|
| 1,867,897 | A | * | 7/1932 | Stanbrough | 52/388 |
| 2,039,098 | A | * | 4/1936 | Marks | 52/385 |
| 3,142,938 | A | * | 8/1964 | Eberhardt | 52/385 |
| 3,775,916 | A | * | 12/1973 | Bair | 52/125.4 |
| 4,642,960 | A | * | 2/1987 | Wallover, III | 52/390 |
| 4,920,716 | A | * | 5/1990 | Coffey | 52/386 |
| 5,129,203 | A | * | 7/1992 | Romero | 52/309.11 |
| 5,373,676 | A | * | 12/1994 | Francis et al. | 52/387 |
| 5,715,637 | A | * | 2/1998 | Hesterman et al. | 52/315 |
| 5,816,005 | A | * | 10/1998 | Han | 52/391 |

(Continued)

*Primary Examiner* — Basil Katcheves

(74) *Attorney, Agent, or Firm* — Razmig Messerian; Loza & Loza, LLP

(57) ABSTRACT

A masonry siding for use on a wall is provided comprising one or more layers for creating masonry siding; and one or more strategically positioned inserts embedded within the one or more layers allowing to secure the masonry siding on a wall. The inserts are positioned in a mold in order to allow for the securing of the masonry siding to a wall or building structure, by screwing a bolt or other similar device through the insert, which runs along the width of the masonry siding. The bolt or screw is then completely hidden from view as it penetrates the front face of the insert completely. A method is also provided for manufacturing a masonry siding with inserts to secure the masonry siding to a wall by providing steps to create the masonry siding from a mold with the inserts within the mold.

20 Claims, 14 Drawing Sheets

(56) References Cited

U.S. PATENT DOCUMENTS

| | | | | |
|---|---|---|---|---|
| 6,240,691 | B1 * | 6/2001 | Holzkaemper et al. | 52/315 |
| 6,898,908 | B2 * | 5/2005 | Messenger et al. | 52/268 |
| 7,647,738 | B2 * | 1/2010 | Nasvik | 52/389 |
| 7,934,352 | B1 * | 5/2011 | Mollinger et al. | 52/748.1 |
| 8,256,179 | B2 * | 9/2012 | Nasvik | 52/516 |
| 2007/0209308 | A1 * | 9/2007 | Barrett | 52/506.05 |
| 2008/0028711 | A1 * | 2/2008 | Logan et al. | 52/512 |
| 2009/0038252 | A1 * | 2/2009 | King | 52/506.05 |
| 2009/0235600 | A1 * | 9/2009 | Logan et al. | 52/314 |
| 2012/0210665 | A1 * | 8/2012 | Park et al. | 52/506.05 |
| 2015/0128514 | A1 * | 5/2015 | Tancredi et al. | 52/302.1 |

* cited by examiner

MASONRY SIDING WITH EMBEDDED INSERTS AND METHOD

CLAIM OF PRIORITY

The present application for patent claims priority to U.S. Provisional Application No. 61/935,292 entitled "Masonry Siding with Embedded Inserts and Method" filed Feb. 3, 2014, the entire disclosure of which is hereby expressly incorporated by reference herein.

BACKGROUND

Field

The invention relates to masonry sliding, more specifically, to masonry siding with embedded inserts.

Background

Brick walls have been used for centuries as a premium building material due to their strength, beauty, and durability. Unfortunately, brick walls are typically laid brick-by-brick, which tends to be time consuming, labor intensive, and therefore expensive. Thin brick veneer was developed as a means for achieving the beauty and durability of brick walls without the associated expense. This also requires a supporting foundation, generally accomplished by making the foundation 4" thicker wherever the intention is to put masonry up the side of a building. Another approach is to bold heavy steel angle to make a "shelf" for masonry brick to sit on. The installation of common brick walls also requires that all openings above windows/doors must be designed to support the weight of the brick wall which results in increase expenses as well as complexity.

Thin brick veneer is produced using a variety of manufacturing methods including thin bed set, thick bed set and prefabrication in cast molds. Thin brick panels can be premanufactured or can be assembled to a wall of a building on-site. Thin brick panels generally include a substratum, such as steel, aluminum, plywood, asphalt-impregnated fiber board, cementitious board, polyurethane, and polystyrene foam board. With the on-site assembly method, the substratum is fastened to the exterior wall of a building and an array of thin bricks are applied to the substratum, typically with an adhesive. Then mortar, or grout, is applied between the thin bricks to obtain a permanent brick veneer wall assembly.

The prior art has suggested a variety of thin brick panel constructions. For example, U.S. Pat. No. 2,924,963 to Taylor et al. teaches a method for attaching a clay veneer brick to pre-existing buildings. Taylor et al. disclose a brick unit, a wall clip, and mortar. The brick unit includes a back side, a face section, and longitudinal ribs along the top and bottom. The longitudinal ribs are beveled at a front side at a 45 degree angle. The clip is made from sheet metal and is made to resiliently receive the brick unit. The clip includes a flat upstanding lug and a bent tail lug, both of which have fastener holes punched there through. Extending perpendicularly from the clip are a plurality of resilient clamping members, each having a downturned lip to resiliently receive a respective longitudinal rib of a respective brick unit. The downturned lip also has an upturned flange, which, when the clip is fitted to the veneer brick, rides against the longitudinal rib of the brick unit, causing the downturned lip to deflect and resiliently retain the brick unit.

Unfortunately the clip of Taylor et al., is unnecessarily complex with many detailed bends. Moreover, an overabundance of individual clips must be handled and secured to a building just to construct a single wall, which is inefficient, labor intensive, and costly. Finally, great amounts of care and time must be given to the precise positioning of each clip to ensure that each brick is squarely aligned with respect to the other bricks.

U.S. Pat. No. 2,087,931 to Wallace et al. teaches a means for attaching bricks to a wall such that each brick is individually supported so that its position in the wall is not dependent upon the other bricks. Specifically, Wallace et al. disclose wall sheeting having a plurality of spaced apart strap members secured thereto by nails. A plurality of support clips are riveted to the strap members at regularly spaced intervals. The support clips have extending portions that are bent outwardly to form arms with inwardly bent terminals for engagement with surfaces of the bricks. The natural resiliency of the clip so constructed forces the terminals into engagement with the brick surfaces. The terminals are angularly disposed relative to the adjacent surfaces of the brick such that a sharp edge of the terminals engage the brick thereby materially increasing the tenacity of the holding action.

The Wallace et al. disclosure relies on a plurality of strap members and a plurality of support clips for applying bricks to a wall. Manufacturing all the components required for the Wallace et al. disclosure and the process of assembling the components to a wall unnecessarily incur additional labor and material cost. Furthermore, Wallace et al. do not teach a means for accommodating oversized and undersized bricks.

U.S. Pat. No. 6,098,363 to Yaguchi teaches a support panel for supporting external wall forming members, or bricks. The bricks are of rectangular parallel piped shape, meaning they have oppositely parallel surfaces all over. The bricks each have a main surface, a rear surface, side surfaces, and end surfaces. The side surfaces include elongated upper and lower lateral extensions that define flat ledges or minor surfaces that are parallel with the main surface. The support panel includes a flat back plate and is stamped from stainless metal sheet to form parallel rows of C-shaped upper and lower engaging members terminating in respective upper and lower securing fingers. The distance between the upper and lower engaging members is substantially identical to the width of a respective brick. A brick is inserted between the upper and lower engaging members. This insertion pushes the upper lateral extension of the brick into a space defined by the upper engaging member and upper securing finger thereby causing the upper engaging member to elastically deform while the lower lateral extension of the brick is urged flat against the back plate of the support panel within the lower engaging member. As a result, the brick is clamped between the upper and lower engaging members and by the bent securing fingers.

In an alternative embodiment, each brick only has an upper lateral extension and an oppositely disposed flat side surface. Respectively, the support panel includes only rows of upper engaging members and securing fingers. Each upper engaging member has an outer, top surface and an inner bottom surface. As before, the upper lateral extension of each brick is pushed into the space defined by the respective upper engaging members such that the upper lateral extension of the brick engages the inner bottom surface of the respective upper engaging member. Simultaneously, the brick is pushed toward the back plate of the support panel until the flat side surface locates against the top surface of the respective engaging member below. Thus, the brick becomes pinched between the upper engaging member and the top of an upper engaging member from the row of upper engaging members below the brick.

In both of the Yaguchi embodiments, however, the support panel clamps on oppositely disposed parallel surfaces of the brick. This is detrimental because the size of the bricks varies significantly compared to the stamping tolerances attainable with the support panel. In other words, either one of two undesirable conditions must occur. The bricks must be held to an extremely close width tolerance to accommodate reliable and repeatable snap fit insertion to the support panel. This is extremely costly, if at all possible, on a mass production basis. Or, each brick must be oversize with respect to the distance between the rows of engaging members to ensure firm clamping of each brick. Oversize bricks will fit fine in the first row of engaging members, but will start to interfere when they are assembled to adjacent rows of engaging members because the engaging members will be filled with bricks and have no room to deflect. Alternatively, if the bricks are undersize, they will fit loosely within the engaging members thereby leading to problems. When the mortar gets applied, loose bricks will shift due to the slack and hairline cracks in the mortar may result.

From the above, it can be appreciated that thin brick panel assemblies of the prior art are not cost effectively optimized to accommodate typical brick tolerances, simplify assembly, and thus lower costs. Therefore, what is needed is masonry siding which can be easily installed through insert means contained within the masonry siding.

SUMMARY

In a first aspect, the present invention provides a masonry siding for use on a wall comprising one or more layers for creating masonry siding and one or more strategically positioned inserts embedded within the one or more layers allowing to secure the masonry siding on the wall.

In a second aspect, the present invention provides a method for creating a masonry siding comprising the steps of a) providing a mold for receiving the one or more layers to create masonry siding; b) securing one or more inserts within the mold allowing for the securing of the masonry siding onto a wall; c) spackling a layer into the mold for providing a first accent layer; d) pouring a second layer into the mold for providing a colored layer; e) vibrating the mold to eliminate voids in the second layer; f) pouring a third layer into the mold for providing a reinforced layer; and g) curing period to allow the masonry siding to be de-molded from the mold.

DETAILED DESCRIPTION

The following embodiments are merely illustrative and are not intended to be limiting. It will be appreciated that various modifications and/or alterations to the embodiments described herein may be made without departing from the invention and any modifications and/or alterations are within the scope of the contemplated invention. The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1:
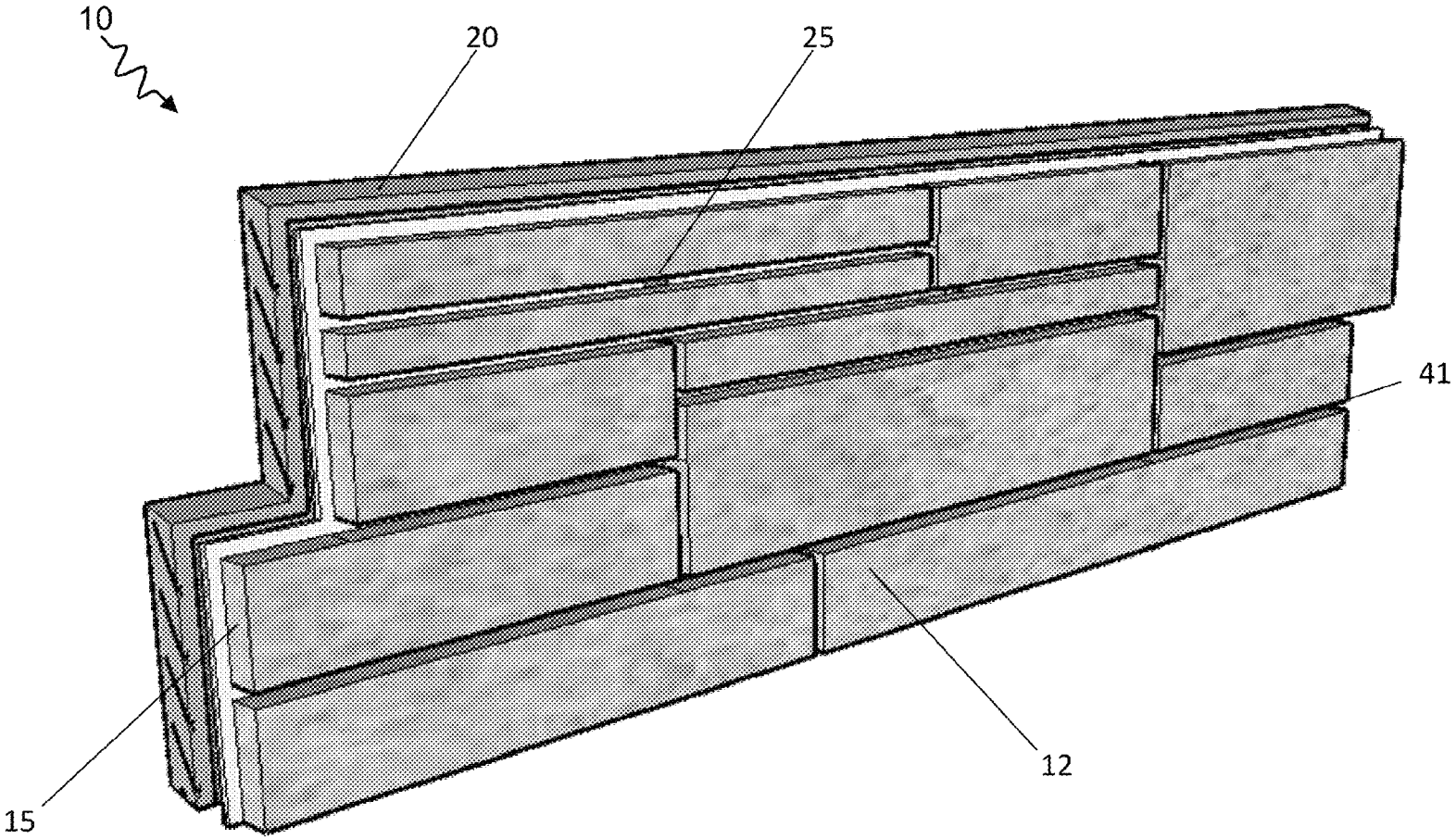
FIG. 1 is a perspective view of the masonry siding according to a first embodiment of the present invention.

With reference to FIG. 1 and according to one embodiment of the present invention, a masonry siding with embedded inserts 10 is shown. The masonry siding 10 is generally comprised of an accent first layer 12, a colored concrete second layer 15, a reinforced concrete third layer 20 and inserts 25. In order to create the completed masonry siding 10, the first, second, third layers 12, 15, 20 and inserts 25 are put together in a mold and cast such that they become one complete piece. The molding process will be further detailed below.

Figure 2:
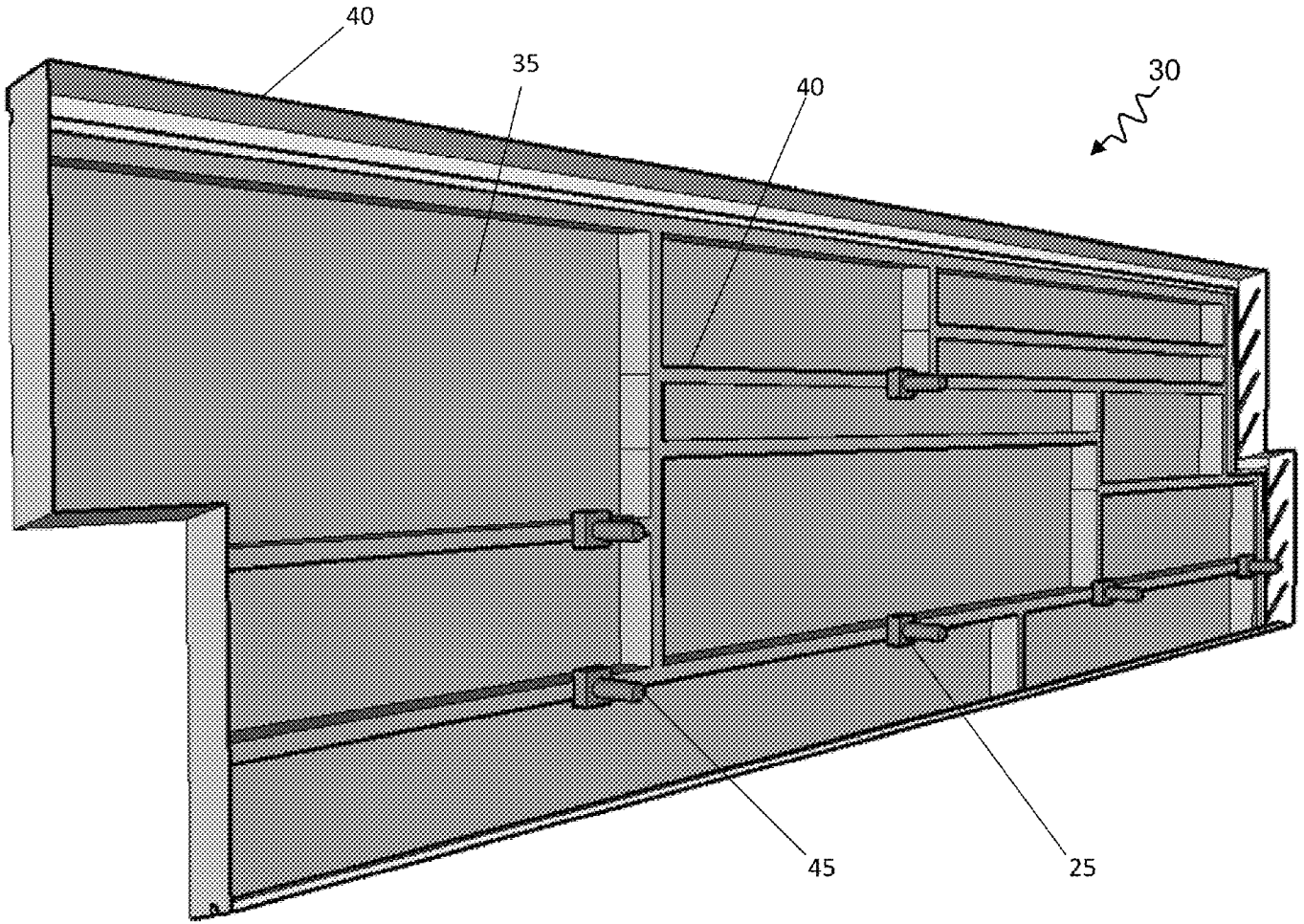
FIG. 2 is a perspective view of the mold for the masonry siding according to a first embodiment of the present invention.

With reference to FIG. 2, a mold 30 is shown which is used to construct and assemble the masonry siding (not shown). Said mold 30 is comprised of cavities 35 of various shapes and sizes, in order to provide for the shapes of the bricks. Inserts 25 are made of rubber and secured on an outline 40 of the mold 30 by means of screws (not shown) which have been screwed into the mold from the head portion (not shown) towards rear, such that only the tips of the screws (not shown) protrude from the outline 40 of the mold 30. The outline 40 defines the mortar joint (not shown)

within the resultant cured masonry siding (not shown). The inserts 25 are strategically positioned within the mold 30 as to be located within the mortar joint (not shown) of the resultant cast masonry siding (not shown). The positioning of the inserts 25 is strategic as it does not affect the overall authentic look of the masonry siding (not shown). The strategic positioning of the inserts 25 simply requires that enough inserts are positioned within the masonry siding allowing for the masonry siding to be securely fixed to a wall. A worker skilled in the relevant art would appreciate that the inserts 25 can be made of other similar materials than rubber, such as elastic or viscoelastic material, urethane, thermoplastic, etc., without departing from the spirit and scope of the present device.

Figure 2A:
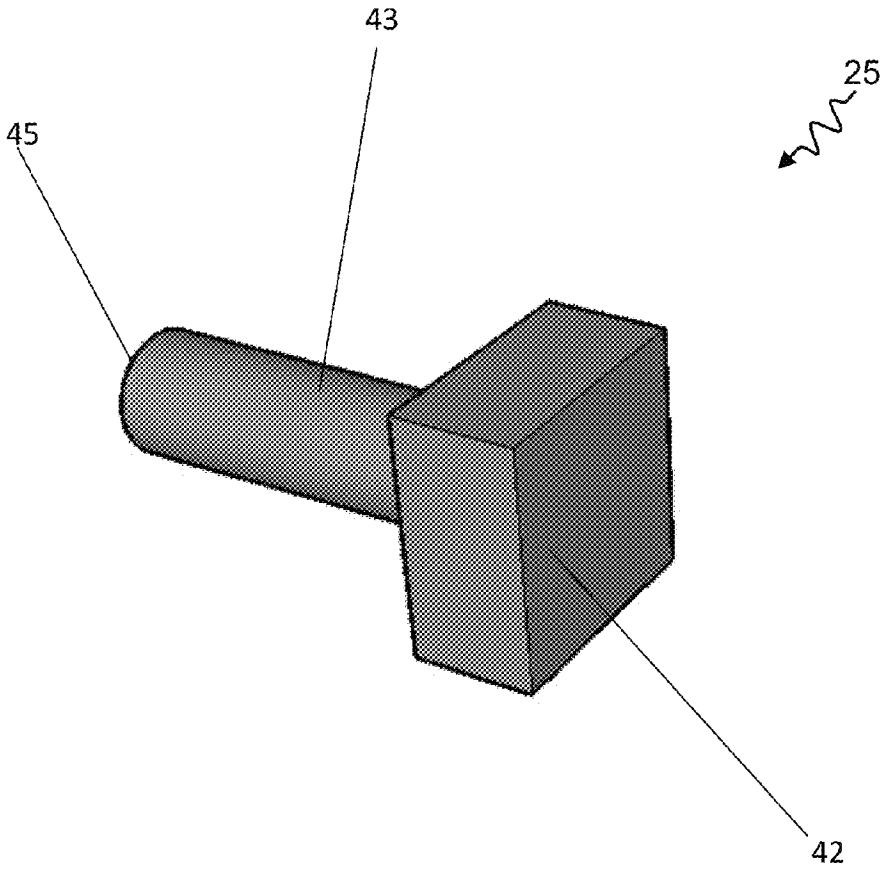
FIG. 2*a* is a perspective view of an insert for the masonry siding according to a first embodiment of the present invention.

With reference to FIG. 2*a* and according to one embodiment of the present invention, the insert 25 is shown in greater detail. The insert 25 is comprised of a head portion 42 that is generally cubic in shape, a cylindrical body 43 that protrudes from the head portion 42, said cylindrical body 43 terminating in an upper tip 45. As was previously explained, the head portion 42 of the insert 25 is secured to the tip (not shown) of a screw (not shown) of the mold (not shown). When the mold (not shown) is removed from the masonry siding (not shown), the head portion 42 is generally flush with the front of the third layer (not shown), while the upper tip 45 is generally flush with the rear of the third layer (not shown). The insert 25 must substantially return to its original size once the tip (not shown) of the screw (not shown) is removed during the demolding process. Further, the head portion 42 of the insert 25 must be sufficiently larger than the bolt (not shown) utilised during installation of the masonry siding (not shown) to a panel or wall. Indeed, the head portion 42 of the insert 25 must flow around the bolt (not shown) as said bolt is driven inwards and towards the wall or panel. Study has shown that a head portion 42 around 2-3 times the size of the head of the bolt (not shown) is sufficient for this purpose. Depending on the color of the second layer (not shown), a worker skilled in the relevant art would appreciate that the color and/or texture of the insert 25 could match the color and/or texture of said second layer (not shown). A worker skilled in the relevant art would also appreciate that a small fissure could exist between the head portion 42 through to the cylindrical body 43 of the insert 25 in order to direct the bolt (not shown) during installation. Other types of inserts 25 are possible and are further detailed below.

With reference to FIGS. 1, 2 and 2*a* and according to one embodiment of the present invention, the process to create the masonry siding 10 is as follows. First, inserts 25 are secured onto screws (not shown) whose tips protrude from the outline 35 of the mold 30, by affixing the head portion 42 of the insert 25 to said tip. The insert 25 will remain in place until the masonry siding 10 is complete, as it is made of a rubber and can easily be removed from the tip at a later time. Second, an accent first layer 12 is spackled onto the mold by means of sprayers which spray the first layer 12 to a specific viscosity and pressure. Third, a colored concrete second layer 15 is then poured into each cavity 35 separately that has been created in the mold 30. The depth of the second layer 15 will be flush with the outline 40 of the mold 30. Each cavity 35 is designed to resemble an old fashioned-style brick or stone as used in older homes and other like structures. As such, the outline 40 forms the mortar joint 41 between the fashioned-style brick or stone on the masonry siding. A worker skilled in the relevant art would appreciate that there can be several colors of the second layer 15, in order to provide different colored stones for a more unique and aesthetically pleasing look. Fourth, once the second layer 15 has been poured, the mold 30 is vibrated on a designated plate which is well-known in the art, in order to remove the voids in the concrete of the second layer 15 and bring any remaining air to the surface. This process is known as consolidation in the relevant industry. A worker skilled in the relevant art would appreciate that at this point in the production, as only the first and second layers 12, 15 have been poured, the only exposed area is the outline 40 of the mold 30, which represents what will eventually become the mortar joints 41 after curing. Therefore, it is possible to add a sub-step which would include spraying the entire mold 30, including the outline 40, with another type of spray which would effectively create another color pattern for the mortar joints 41. This type of sub-step would be particularly beneficial for stone patterns with larger, wider stones where mortar joints 41 are highly visible. Fifth, a reinforced concrete third layer 20 is poured on top of the second layer 15, up to a depth that is approximately equal to outer edge 40 of the mold 30. Sixth, once the third layer 20 has been poured, the mold 30 is vibrated again in order to remove the voids in the concrete of the third layer 20 and bring any remaining air to the surface. At this stage, the upper tip 45 of the inserts 25 should be approximately flush with both the third layer 20 and the outer edge of the mold 30. Sixth, the entire masonry siding 10 is cured, typically for a period of 24 hours until they have retained enough strength to demold. Seventh, the masonry siding 10 is demolded by removing said masonry siding 10 from the mold 30. Eighth, the masonry siding is further cured for a certain period of time, which consists of a minimum of 24 hours but typically of 7 days in a humid environment known in the art, which is the typical period of time until said masonry siding is strong enough to be shipped. A worker skilled in the relevant art would be familiar with the ability to produce masonry siding with only a single layer rather than three layers as described above. The masonry siding of the present invention could have one or more layers as required and as would be known by a worker skilled in the relevant art.

Figure 3:
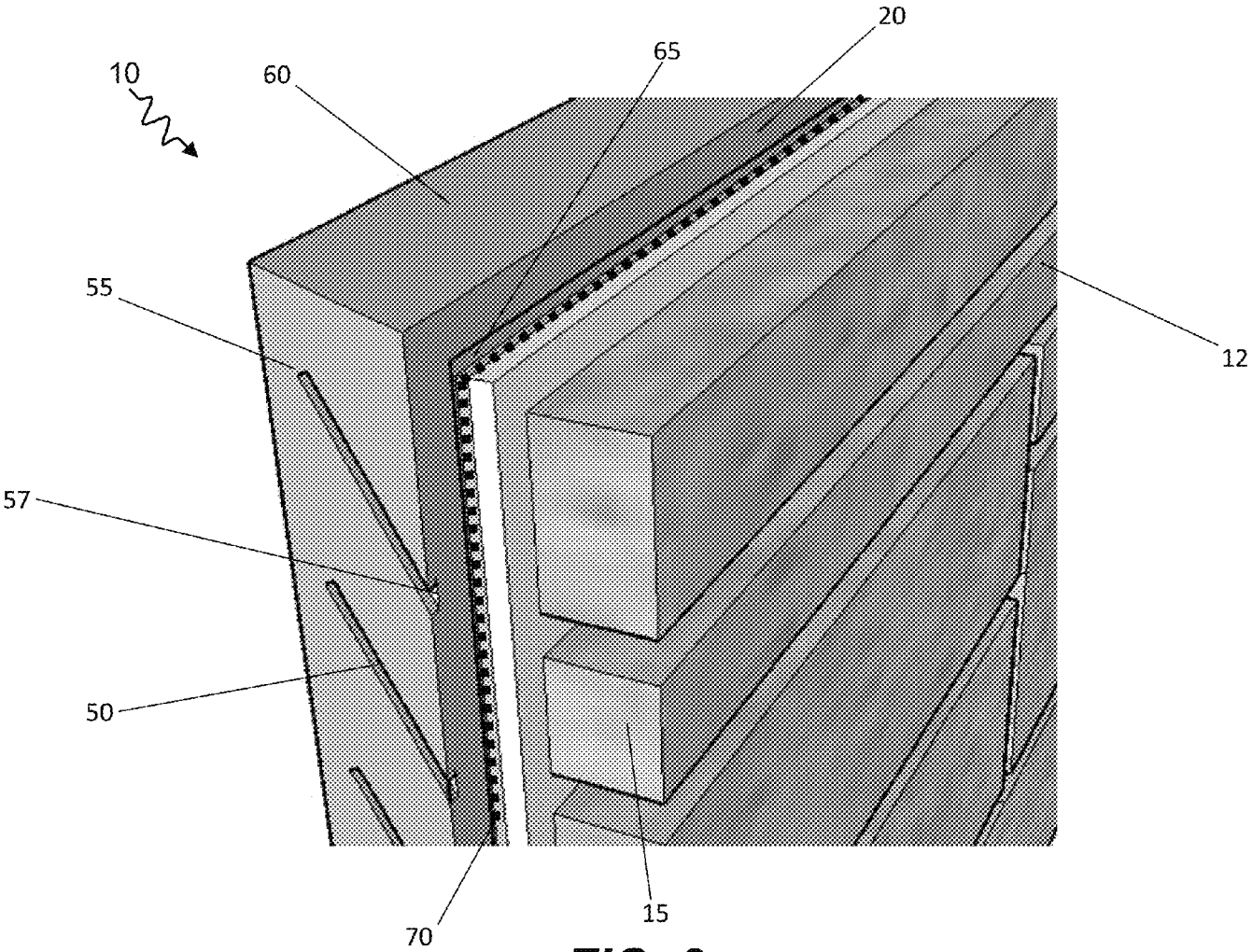
FIG. 3 is a detailed perspective view of the various drain channels in the masonry siding according to a first embodiment of the present invention.

With reference to FIG. 3 and according to one embodiment of the present invention, the first, second and third layers 12, 15, 20 of the masonry siding 10 are shown in greater detail. The third layer 20 is generally comprised of side drain channels 50 which extend from a first position 55 near the rear of the third layer 20 (which is to say the outer edge of the mold), laterally in a declined slope to a second position 57 located flush with the front of the third layer 20. The side drain channels 50 are positioned beginning from the top 60 of the third layer 20 and repeated until the bottom (not shown) of said third layer 20. The side drain channels 50 allow for and redirect water precipitation to drain away from the rear of the masonry siding 10 and towards the front of the third layer 20, which in turn prevents damage to the building structure defined as either or a wall or panel or other type of surface, to which the masonry siding 10 is affixed. Indeed, as the rear of the masonry siding 10 is fastened to a wall or other similar structure, it is advantageous to redirect water to the front of the third layer 20 of the masonry siding 10. The top 60 of the third layer 20 is sloped by approximately 20° in order to direct water and other precipitation along the surface of said top 60 and have it drain to front drain channel 65, which is defined along stippled line path 70. Stippled line path 70 extends around the sides and upper perimeter of the second layer 15. The third layer could have a slope ranging from 1 degree to 60 degrees. The top 60 could also have no slope.

Figure 4:
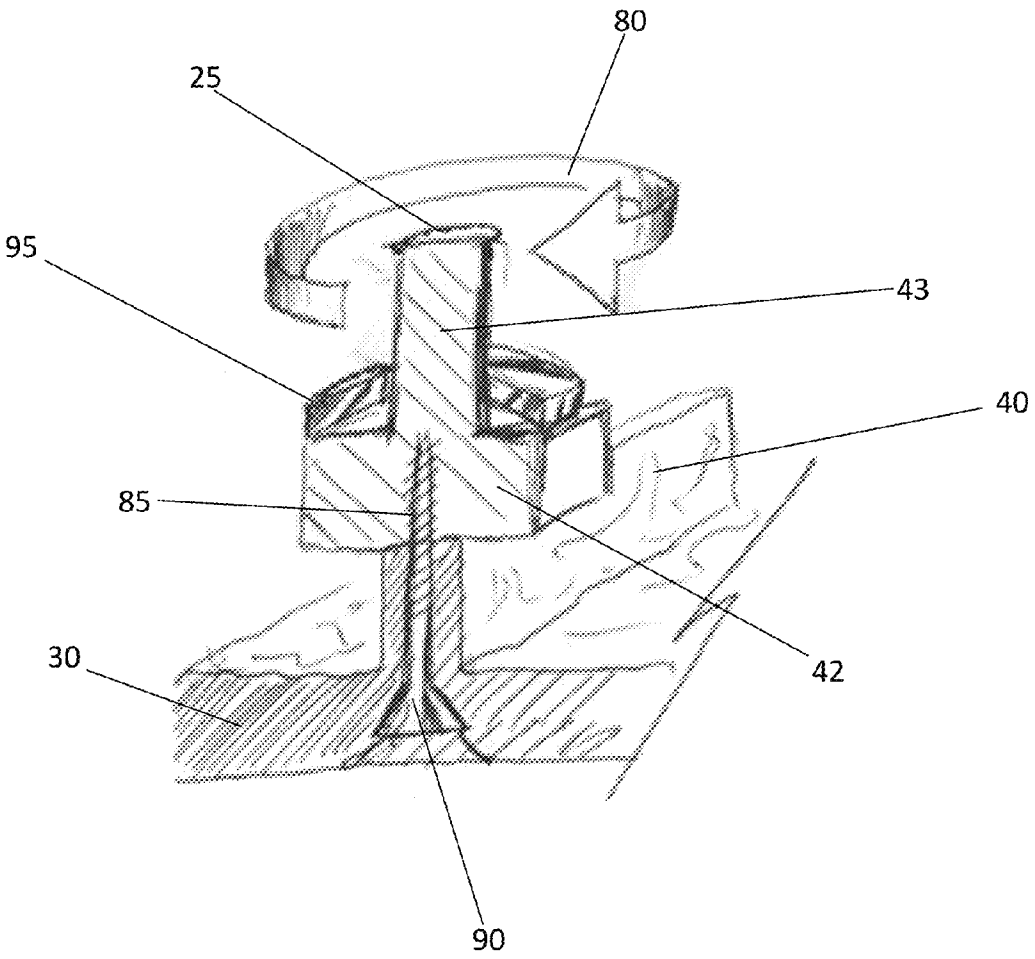
FIG. 4 is cross-sectional view of an insert being secured to a screw on a mold according to a first embodiment of the present invention.

With reference to FIG. 4 and according to one embodiment of the present device, the installation of the insert 25 to the outline 40 of the mold 30 is shown. Arrow 80 shows the motion of the insert 25 relative to the tip 85 of the screw 90 in order to secure said insert 25 to said tip 85. A washer 95 is also shown located between the head portion 42 and the cylindrical body 43 of the insert 25. This washer 95 allows for greater bearing strength to be provided by a bolt (not shown) that will be used to fasten the masonry siding (not shown) to a wall. Said washer 95 may also be in a dished (conical) shape so as to guide the direction of the bolt (not shown) properly into the insert 25. A worker skilled in the relevant art would appreciate that the insert 25 could be secured to the mold 30 by other means than the one described above. Indeed, the insert 25 could be secured to the mold 30 by means of sharp pneumatically driven pins that would extend up from the mold 30 in the same manner as the screws 90, or in another embodiment, a small magnet could be placed in the mold 30 and attract the ferromagnetic washer 95 to keep the insert 25 in place. In another embodiment, temporary adhesive could be utilized, such as a fast acting water-soluble adhesive. In another embodiment, a piercing, hollow pin projecting up from the mold would be sufficient, such that when the insert would be pierced by the hollow pin, a vacuum could be applied to the pin to hold it in place. The added benefit of this feature would be that the pins could be pressurized to inject air between the cast panel (masonry siding) and mold, thereby substantially assisting in the demolding operation. A worker skilled in the relevant art would appreciate that the purpose of the positioning of the insert on the mold is to securely position said insert during filling and vibration process, while sealing the contact surfaces of the mold and insert from concrete paste.

Figure 5:
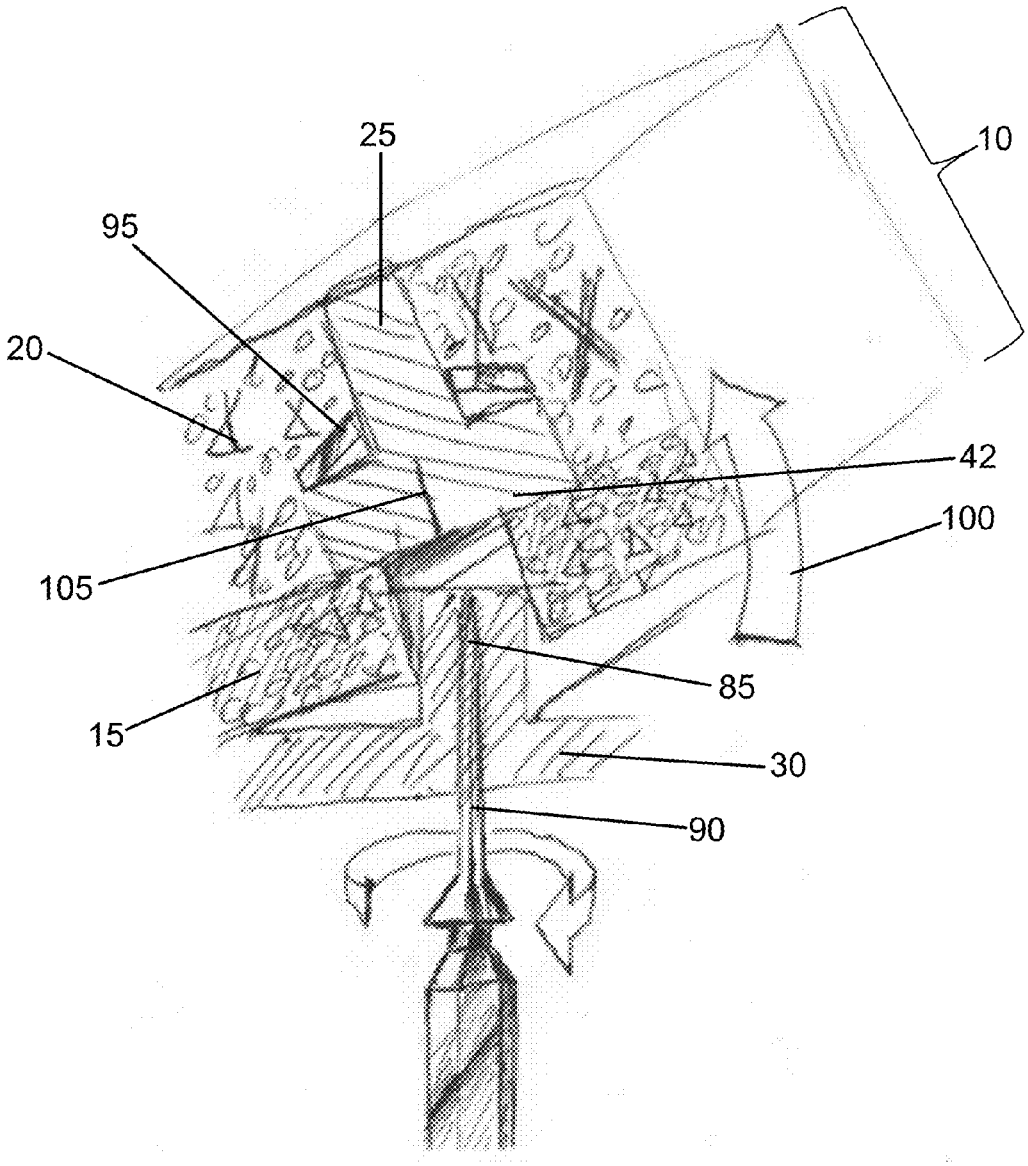
FIG. 5 is a cross-sectional view of the cured masonry siding being removed from the mold according to a first embodiment of the present invention.

With reference to FIG. 5 and according to one embodiment of the present device, the masonry siding 10 is shown cured and being removed from the mold 30, as represented by arrow 100. The insert 25 and washer 95 have now been set in the third layer 20, and the head portion 42 of the insert 25 is flush with the second layer 15. The screw 90 is shown being removed from the mold 30, which leaves a small aperture 105 in the insert 25. In ideal conditions, the small aperture 105 barely changes the shape of the insert 25, such that said insert 25 does not expand or retract from the addition and removal of the tip 85 of the screw 90.

Figure 6:
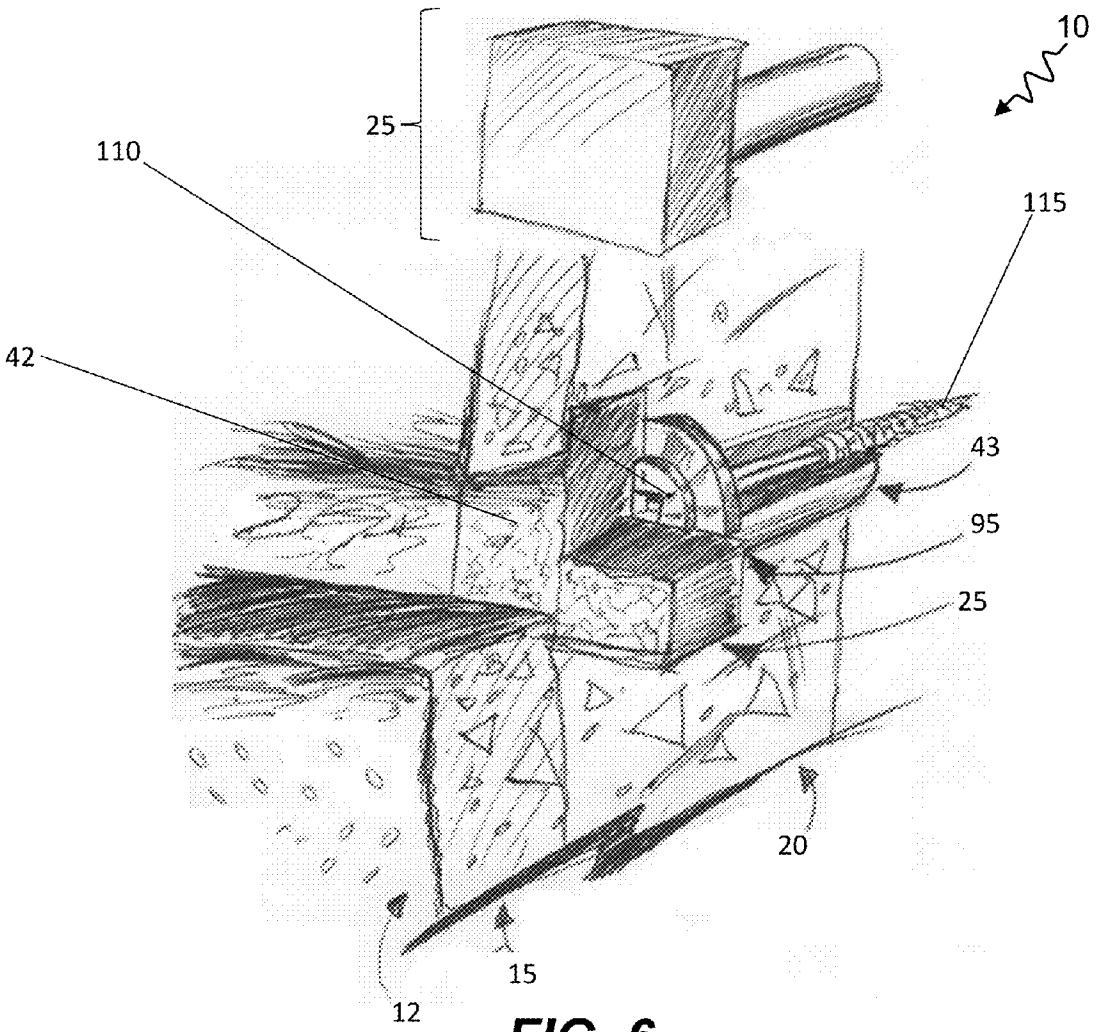
FIG. 6 is a cross-sectional view of a bolt screwed into an insert of the masonry siding according to a first embodiment of the present invention.

With reference to FIG. 6 and according to one embodiment of the present invention, the bolt 110 which secures the masonry siding 10 to a panel or wall is shown. A wall is defined as any surface which can receive the masonry siding as defined under this invention. The bolt 110 is positioned in between two or more adjacent bricks that are formed by the first and second layers 12, 15 and in the center of the head portion 42 of the insert 25. In order to secure the masonry siding 10 to the wall or panel, said masonry siding 10 is firstly affixed in the desired position on said wall or panel. The next step is to fasten in the masonry siding 10 by means of positioning the bolt 110 as was described above and screwing said bolt 110 in the head portion 42 of the insert 25. Once the bolt tip 115 of the bolt 110 has reached the washer 95, which is located between the cylindrical body 43 and the head portion 42 of the insert 25, said bolt tip 115 is guided by the washer 95 into said cylindrical body 43 of the insert 25 and ultimately through to the wall or panel. The flexible and malleable nature of the insert 25 allows for the bolt 110 to be completely hidden from view in order to be more aesthetically pleasing on the masonry siding 10.

Figure 7:
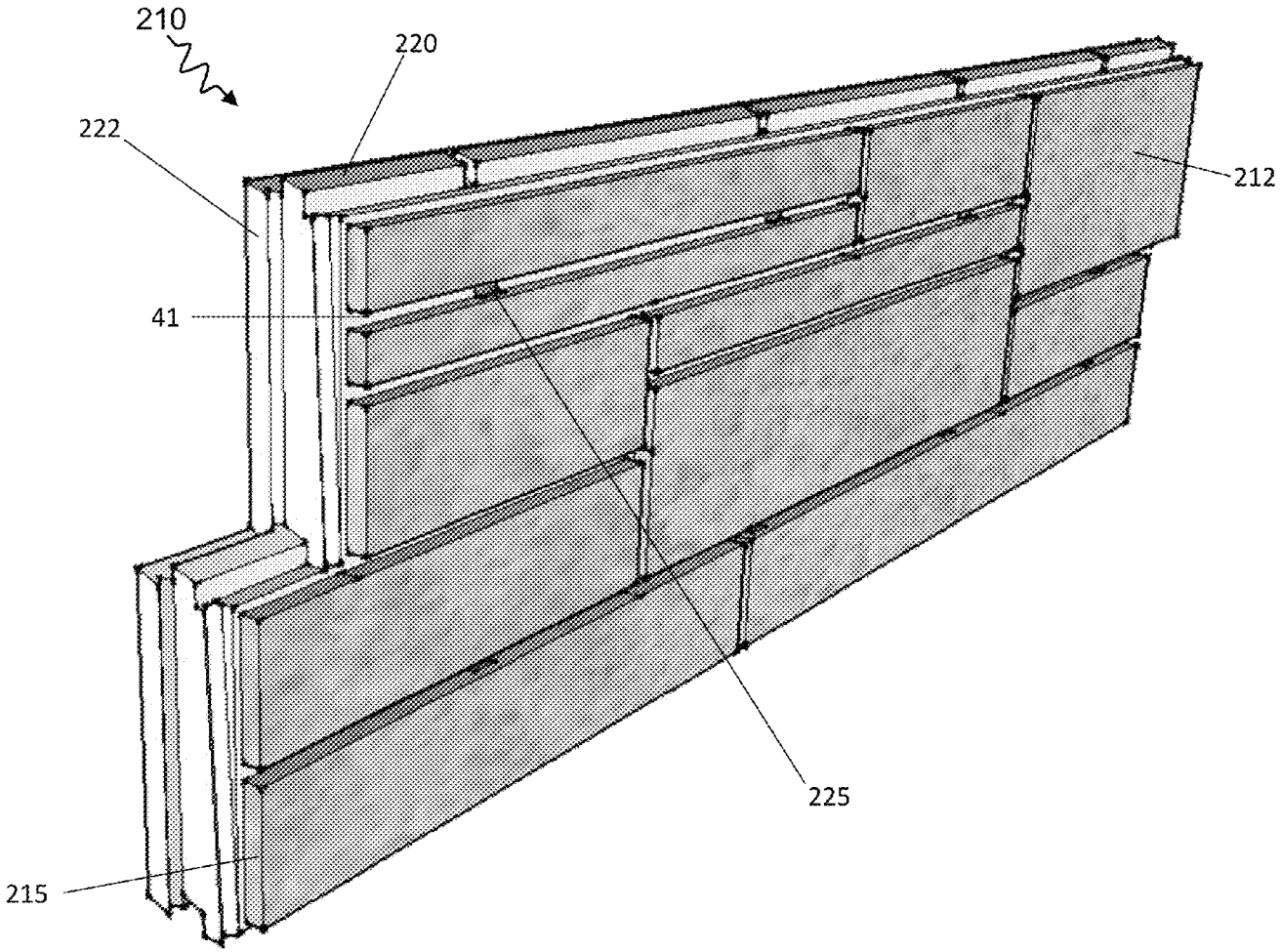
FIG. 7 is a perspective view of the masonry siding according a second embodiment of the present invention.

With reference to FIG. 7 and according to a second embodiment of the present invention, masonry siding 210 is shown primarily comprised of a first, second, third and fourth layers 212, 215, 220, 222. Inserts 225 are also shown which serve to assist in the securing of the masonry siding 210 to a wall or panel. As was the case in the first embodiment, the inserts 225 are strategically positioned within the mortar joints 41. In addition, as was the case in the first embodiment, an accent first layer 212 is applied first, followed by a colored concrete second layer 215 and a reinforced concrete third layer 220. The fourth layer 222 is utilized as a form of redundancy. In other words, the fourth layer 222 becomes a redundant third layer 220, which will further serve to catch any additional water that is draining down from an adjacent masonry siding 10 that would be located above.

Figure 8:
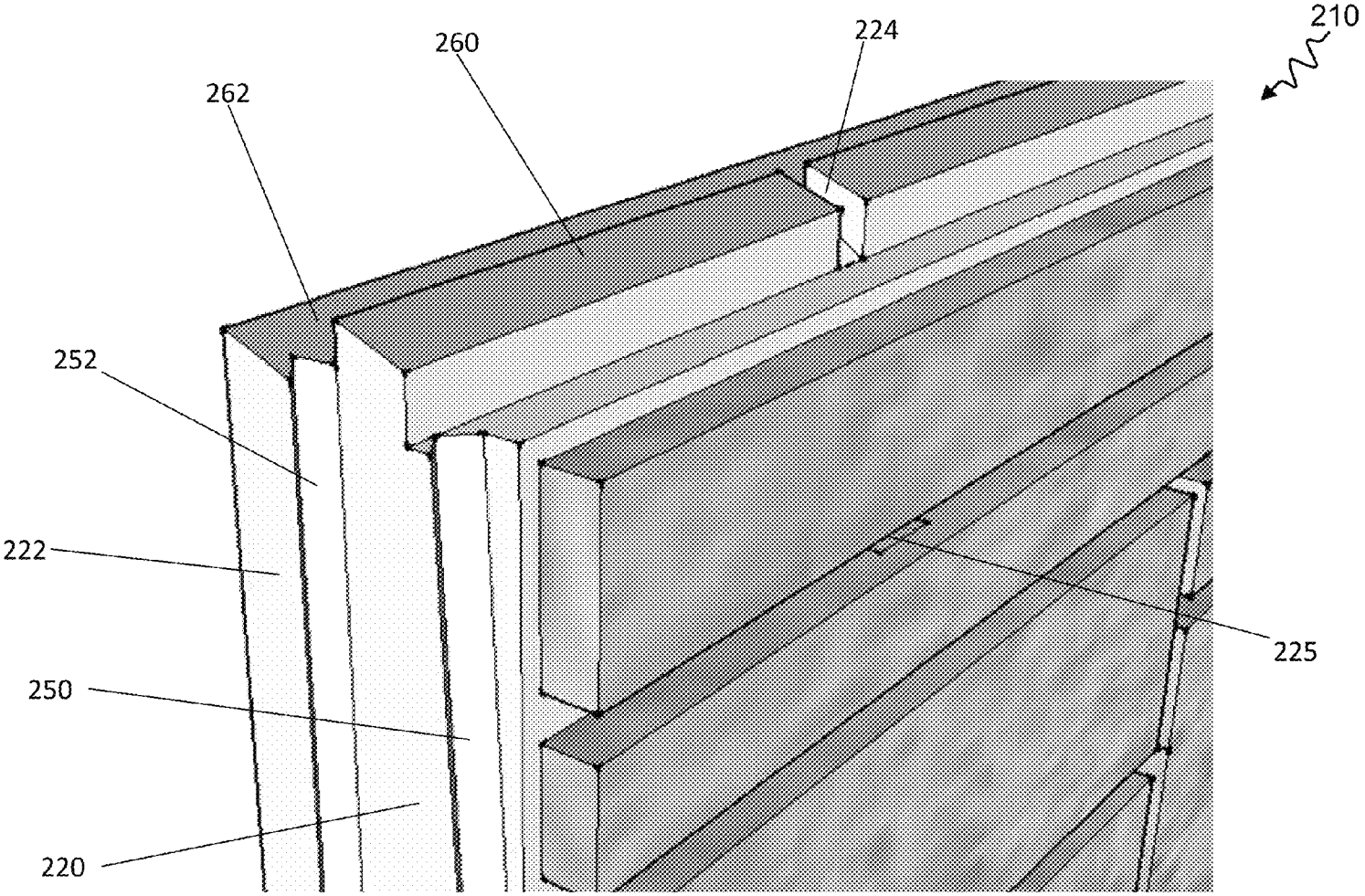
FIG. 8 is a detailed perspective view of the various drain channels of the masonry siding according to a second embodiment of the present invention.

With reference to FIG. 8 and according to a second embodiment of the present invention, weep slots 224 are located on the top 260 of the third layer 220. Said weep slots 224 allow for the visual identification of the inserts 225 on the masonry siding 210. The top 260 of the third layer 220 is also sloped by approximately 20° in order to direct water and other precipitation along the surface of said top 260 and have it drain to the first drain channel 250. First drain channel 250 is constructed and arranged to be in a V-shape to direct said rain and precipitation down. The fourth layer 222 also has its own sloped top 262 by approximately 20° to direct additional rain and precipitation towards a second drain channel 252. Said second drain channel 252 is V-shaped and directs downward flowing moisture on the largely vertical second drain channel 252 outwards to the next successive masonry siding 10 located below.

Figure 9B:
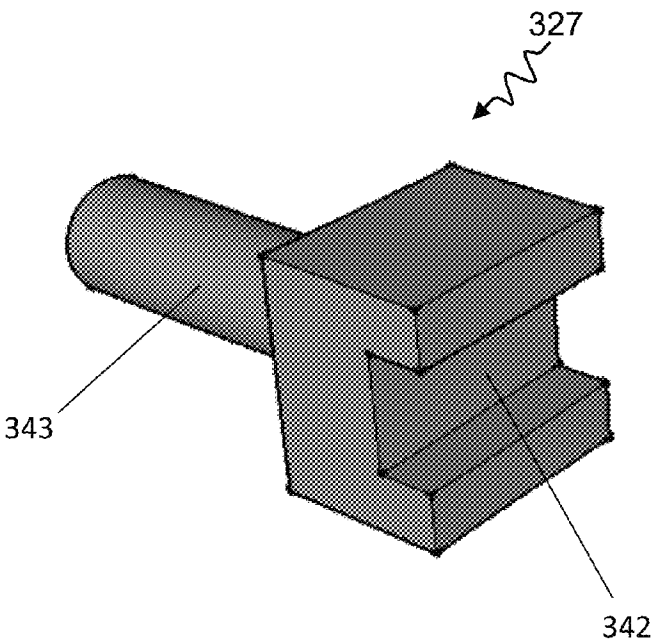
FIG. 9*b* is a perspective view of a second insert according to a third embodiment of the present invention.
Figure 9A:
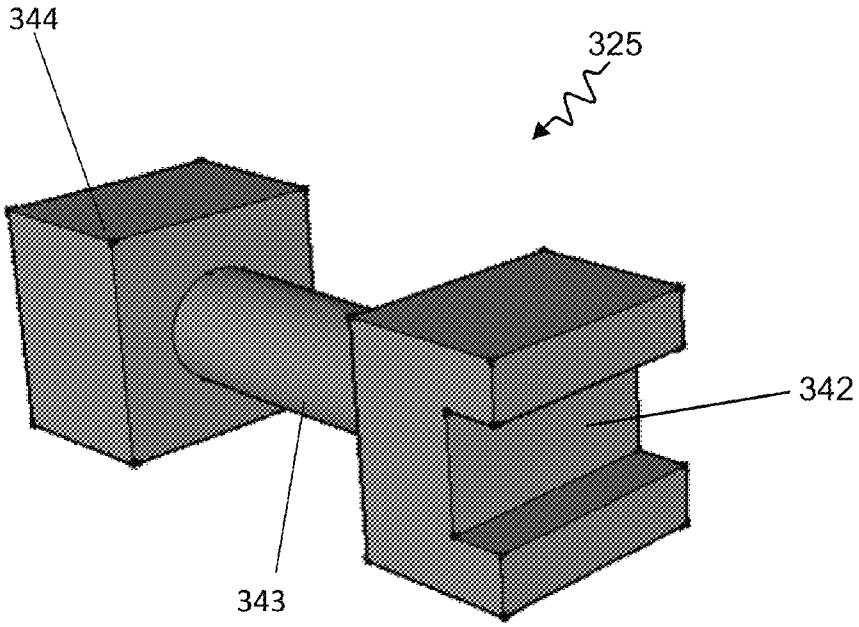
FIG. 9*a* is a perspective view of a first insert according to a third embodiment of the present invention.

With reference to FIGS. 9*a* and 9*b* and according to a third embodiment of the present invention, first and second inserts 325, 327 are shown, each primarily comprised of a cylindrical body 343 and head portion 342. First insert 325 is further comprised of a rear portion 344, while second insert is further comprised of upper tip 345, both rear portion 344 and upper tip 345 opposite respective head portion 342.

Figure 10:
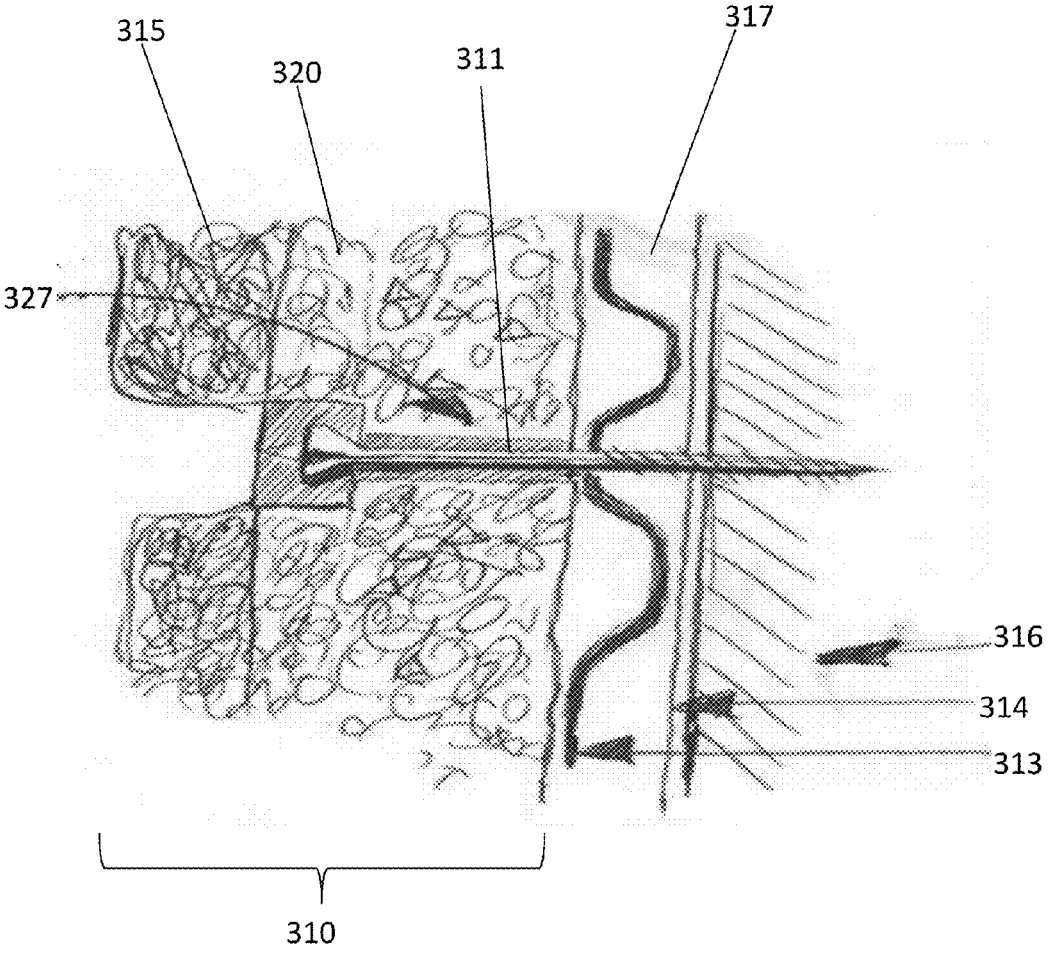
FIG. 10 is a cross-sectional view of a bolt driven into the second insert to secure the masonry siding to the building structure according to a third embodiment of the present invention.

With reference to FIG. 10 and according to a third embodiment of the present invention, second insert 327 is shown secured in between second and third layers 315, 320 within the masonry siding 310. A bolt 311 has been screwed into the second insert 327 and through a plastic dimple membrane 313, said plastic dimple membrane 313 located in an approximately 10 mm area 317 in between the masonry siding 310 and a house wrap 314 of the building structure 316, which could be a panel or wall or anything of the like. Said bolt 311 has positively secured the masonry siding 310 to the panel 316.

Figure 11:
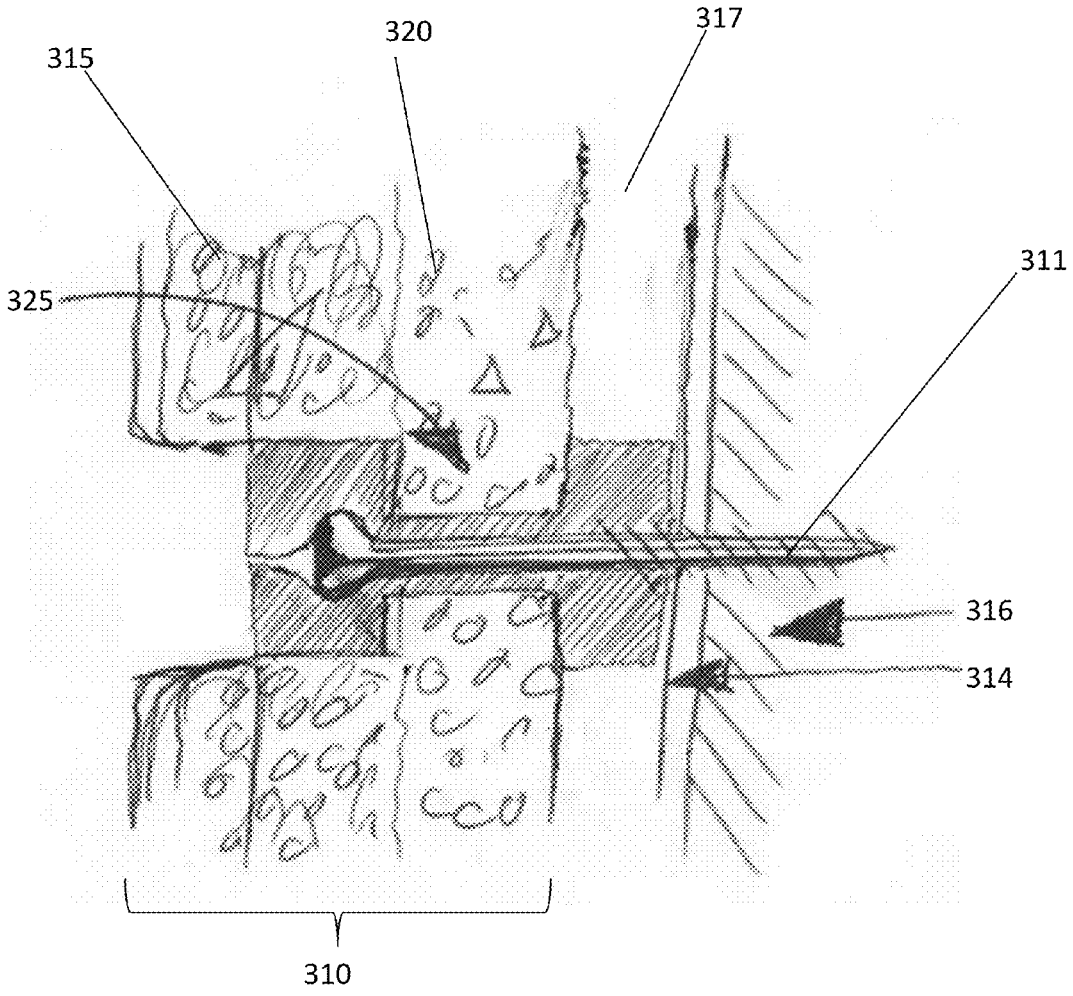
FIG. 11 is a cross-sectional view of a bolt driven into the first insert to secure the masonry siding to the building structure according to a third embodiment of the present invention.

With reference to FIG. 11 and according to a third embodiment of the present invention, the first insert 325 is shown secured in between second and third layers 315, 320 within the masonry siding 310. A bolt 311 has been screwed into the first insert 325 and through the rear portion 344 of said first insert 325, which separates the third layer 320 of the masonry siding 310 from the house wrap 314 and building structure 316. Indeed, the rear portion 344 is approximately 10 mm in width in order to provide the appropriate distance between the masonry siding 310 and the building structure 316 as required by most standard building codes, therefore eliminating the need for the plastic dimple membrane (not shown).

Figure 12:
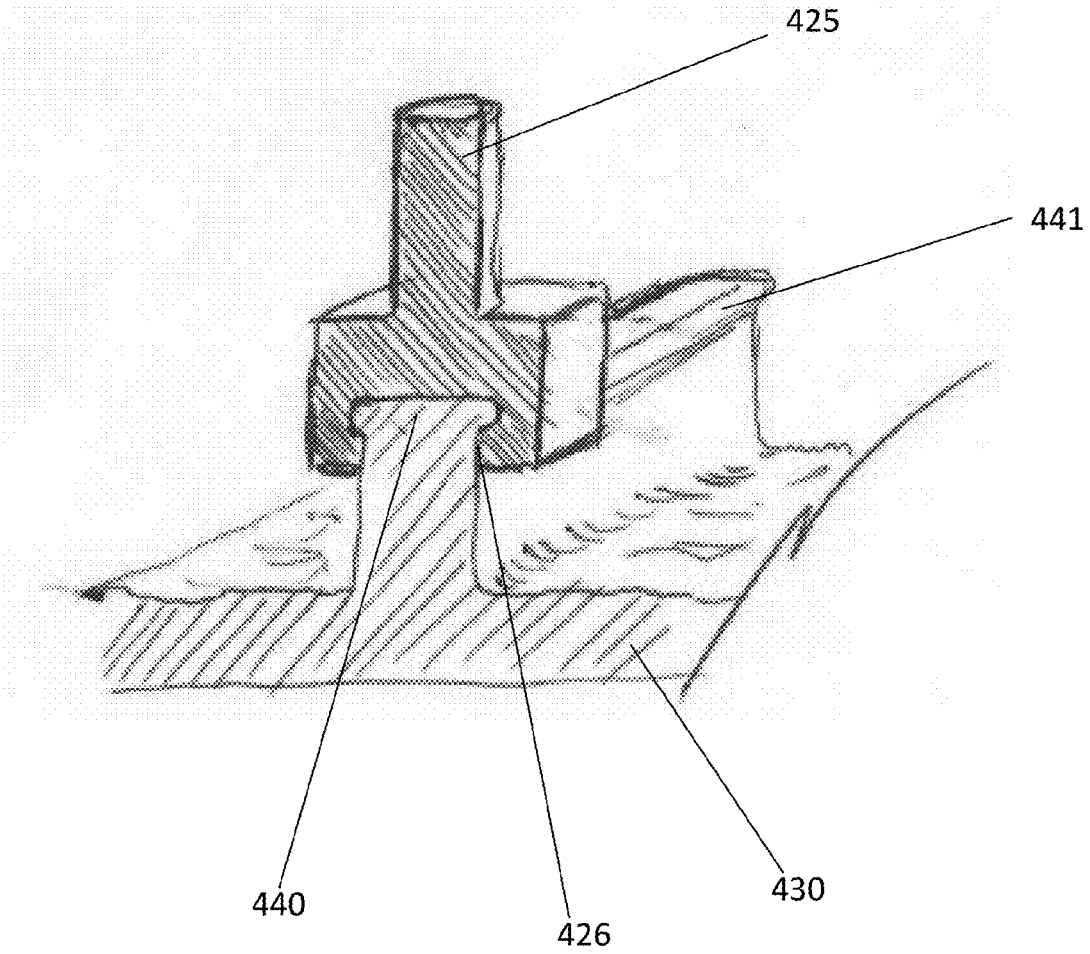
FIG. 12 is a cross-sectional view of an insert secured to an outline of a mold according to a fourth embodiment of the present invention.

With reference to FIG. 12 and according to a fourth embodiment of the present invention, an insert 425 is shown, further comprised of additional protrusions 426 to connect and be secured to corresponding ridges 441 of the outline 440 of the mold 430. In this manner, the screw (not shown)

that was present in the earlier embodiments is not necessary to hold said insert 425 in place on the outline 440 of the mold 340.

Figure 13:
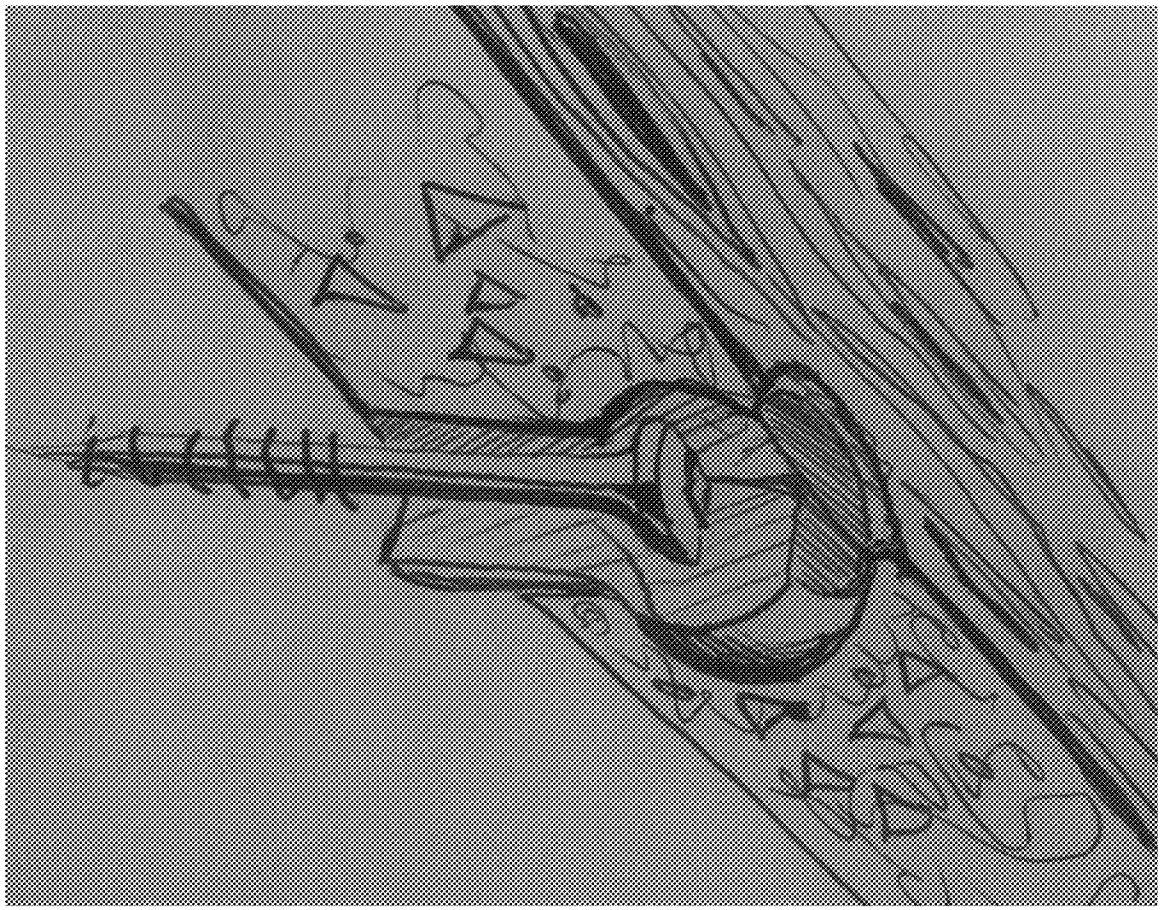
FIG. 13 is a semi cross-sectional view of an insert within a wood panel, said wood panel secured in place by means of screw, according to another embodiment of the present invention.

A worker skilled in the relevant art would appreciate that the concept of rubber inserts as presented in the above description can be applied in a plethora of other fields that require securing a surface to another while hiding the screw or bolt or other fastening means. An example of this is with wood texture panels with no mortar joints (not shown). In that instance, rubber inserts would be positioned directly on the surface of the mold and would be seen as nail heads in the finished product. An example of such a system is shown in FIG. 13. In another exemplary embodiment, the insert could actually protrude from the finished panel in the shape of another fastener such as a large hex head bolt, nut or threaded rod. This system would be particularly advantageous in an application where the purpose would be to show or simulate the shape of the bolt or rod in the design's appearance for aesthetic purposes.

Many modifications of the embodiments described herein as well as other embodiments may be evident to a person skilled in the art having the benefit of the teachings presented in the foregoing description and associated drawings. It is understood that these modifications and additional embodiments are captured within the scope of the contemplated invention which is not to be limited to the specific embodiment disclosed.

What is claimed is:

1. Siding for use on a wall, the siding comprising:

one or more layers defining a front-side surface of the siding and a backside surface of the siding, the front-side surface including at least one mortar joint recessed from the front-side surface; and at least one insert positioned in the one or more layers, the insert having a first end and a second end where at least a portion of the first end of the insert is exposed at the mortar joint and recessed from the front-side surface, and a body of the insert extends through a depth of the one or more layers so that the second end of the insert is positioned substantially at the backside surface of the siding, the first end of the insert adapted to receive a fastener to pass through the insert and out through the second end of the insert to secure the siding to the wall, the first end of the insert comprised of an elastomer adapted to substantially rebound and cover a head of a fastener passing through the insert.

2. The siding according to claim 1, wherein the one or more layers for creating the masonry siding are comprised of three layers defined as an accent first layer, a colored second concrete layer, and a reinforced concrete third layer.

3. The siding according to claim 1, wherein the one or more layers has a layer having a top surface having a 20 degree angle.

4. The siding according to claim 1, wherein the one or more layers has a layer having one or more side drain channels.

5. The siding according to claim wherein the siding further comprises a front drain channel.

6. The siding according to claim 1, wherein the one or more layers is comprised of four layers defined as an accent first layer, a colored concrete second layer, a reinforced concrete third layer, and a redundant reinforced concrete fourth layer.

7. The siding of claim 1, wherein the first end of the insert includes a head having a minimum diameter that is larger than a maximum diameter of the body of the insert.

8. The siding of claim 7, wherein the head is embedded within the one or more layers except for a front surface of the head that is exposed at the mortar joint.

9. The siding of claim 8, wherein the front surface of the head includes a channel.

10. The siding of claim 7, wherein the head is a cuboid.

11. The siding of claim 1, wherein the second end of the insert is exposed at the backside of the siding.

12. The siding of claim 1, wherein the second end of the insert includes a rear portion having a minimum diameter that is larger than a maximum diameter of the body of the insert, the rear portion extending past the backside surface of the siding.

13. A method for creating a masonry siding comprising the steps of:

providing a mold for receiving one or more layers to create masonry siding;

securing at least one elastomer insert within the mold, the insert having a first end and a second end;

spackling a layer into the mold for providing a first accent layer;

pouring a second layer into the mold for providing a colored layer;

vibrating the mold to eliminate voids in the second layer;

pouring a third layer into the mold for providing a reinforced layer; and curing period to allow the masonry siding to be demolded from the mold;

wherein the insert is positioned in the colored and reinforced layers and at least a portion of the first end of the insert is exposed at a mortar joint of the colored layer that is recessed from the accent layer, and the second end of the insert is positioned at or substantially near a backside surface of the reinforced layer, the first end of the insert adapted to receive a fastener to pass through the insert and out through the second end of the insert to secure the masonry siding to a wall.

14. The method of claim 13, wherein the first end of the insert includes a head having a minimum diameter that is larger than a maximum diameter of the body of the insert.

15. Siding for walls, the siding comprising:

one or more layers defining a front-side surface of the siding and a backside surface of the siding, the front-side surface being at least one of stone, brick, or cement, the front-side surface including a groove; and a plurality of inserts embedded in the one or more layers, the inserts each having a first end and a second end where at least a portion of the first end of the inserts are exposed at the groove and recessed from the front-side surface of the siding, and a body of the insert extends through a depth of the one or more layers so that the second end of the insert is exposed at the backside surface of the siding, the first end of the insert adapted to receive a fastener to pass through the insert and out through the second end of the insert to secure the siding to a wall, the first end of the insert comprised of an elastomer adapted to substantially rebound and cover a head of a fastener passing through the insert.

16. The siding of claim 15, wherein the first end of the insert includes a head having a minimum diameter that is larger than a maximum diameter of the body of the insert.

17. The siding of claim 16, wherein the head is embedded within the one or more layers except for a front surface of the head that is exposed at the mortar joint.

18. The siding of claim 17, wherein the front surface of the head includes a channel.

19. The siding of claim 16, wherein the head is a cuboid.

20. The siding of claim 15, wherein the second end of the insert includes a rear portion having a minimum diameter that is larger than a maximum diameter of the body of the insert, the rear portion extending past the backside surface of the siding.

* * * * *